US006644682B2

(12) United States Patent
Horn

(10) Patent No.: US 6,644,682 B2
(45) Date of Patent: Nov. 11, 2003

(54) SAFETY BINDING FOR SKI BOOT

(75) Inventor: Hans Horn, Berne (CH)

(73) Assignee: Look Fixations S.A., Nevers (FR)

( * ) Notice: Subject to any disclaimer, the term of this patent is extended or adjusted under 35 U.S.C. 154(b) by 127 days.

(21) Appl. No.: 09/996,093

(22) Filed: Nov. 28, 2001

(65) Prior Publication Data

US 2002/0063412 A1 May 30, 2002

(30) Foreign Application Priority Data

Nov. 28, 2000 (FR) ..... 00 15310

(51) Int. Cl.[7] ..... A63C 9/00
(52) U.S. Cl. ..... 280/612; 280/613
(58) Field of Search ..... 280/634, 612, 280/613, 626, 629

(56) References Cited

U.S. PATENT DOCUMENTS

| | | | | |
|---|---|---|---|---|
| 4,589,673 A | * | 5/1986 | Dimier et al. | 280/630 |
| 4,715,132 A | * | 12/1987 | Pozzobon | 280/613 |
| 5,121,939 A | | 6/1992 | Peyre | |
| 5,639,108 A | | 6/1997 | Challande et al. | |
| 5,722,679 A | | 3/1998 | Challande et al. | |

FOREIGN PATENT DOCUMENTS

| | | |
|---|---|---|
| CH | 686 707 A5 | 6/1996 |
| DE | 198 00 702 A1 | 7/1999 |
| EP | 0 739 646 A1 | 10/1996 |
| FR | 1.503.847 | 10/1967 |
| FR | 1.503.848 | 10/1967 |
| FR | 1.503.849 | 10/1967 |
| WO | WO 96/32168 | 10/1996 |

OTHER PUBLICATIONS

French Preliminary Search Report in SN FR 0015310.

* cited by examiner

*Primary Examiner*—Lesley D. Morris
*Assistant Examiner*—Paul Royal, Jr.
(74) *Attorney, Agent, or Firm*—Bognion S.A.; John Moetteli

(57) ABSTRACT

The combination of a binding and boot is provided. The binding has a pair of pistons (7, 8) extending under the boot. Each piston is stressed by a spring (14, 15). The arms of a sole clamp (2, 3) act on these pistons. The pistons are connected together by a linking device (20). The combination magnetically controls the linking device which is capable of occupying a first position, in which the pistons are secured by the linking device, and a second position in which one of the pistons is able to move on its own, at least over a certain travel common to the two pistons. The combination thus provides asymmetrical release resistance.

26 Claims, 12 Drawing Sheets

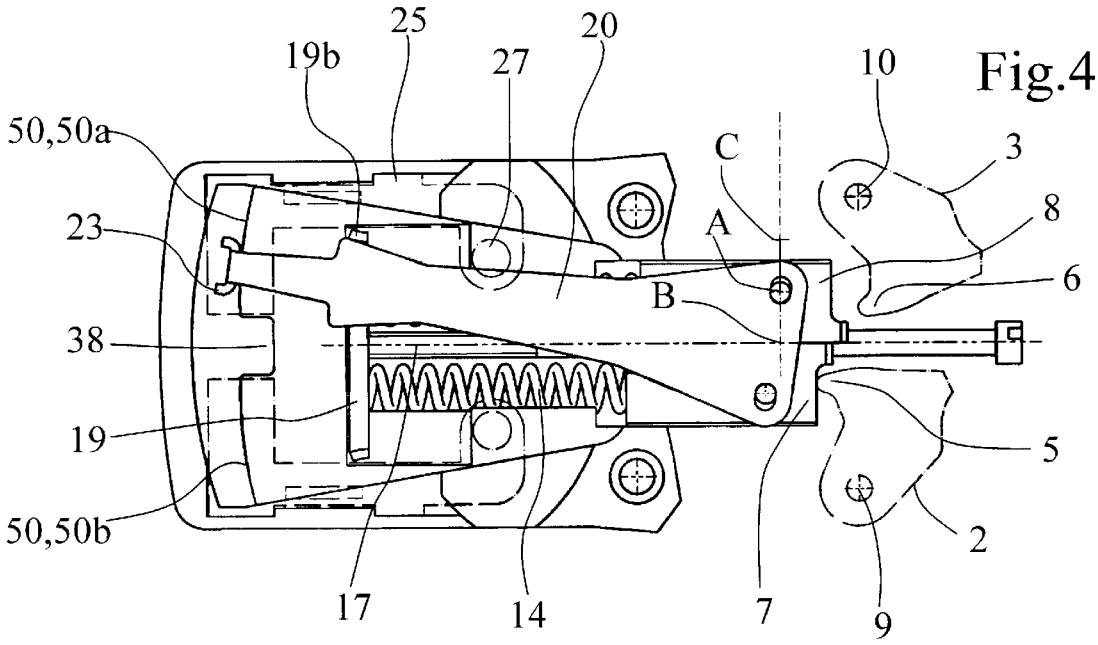
Fig.4
Fig.5
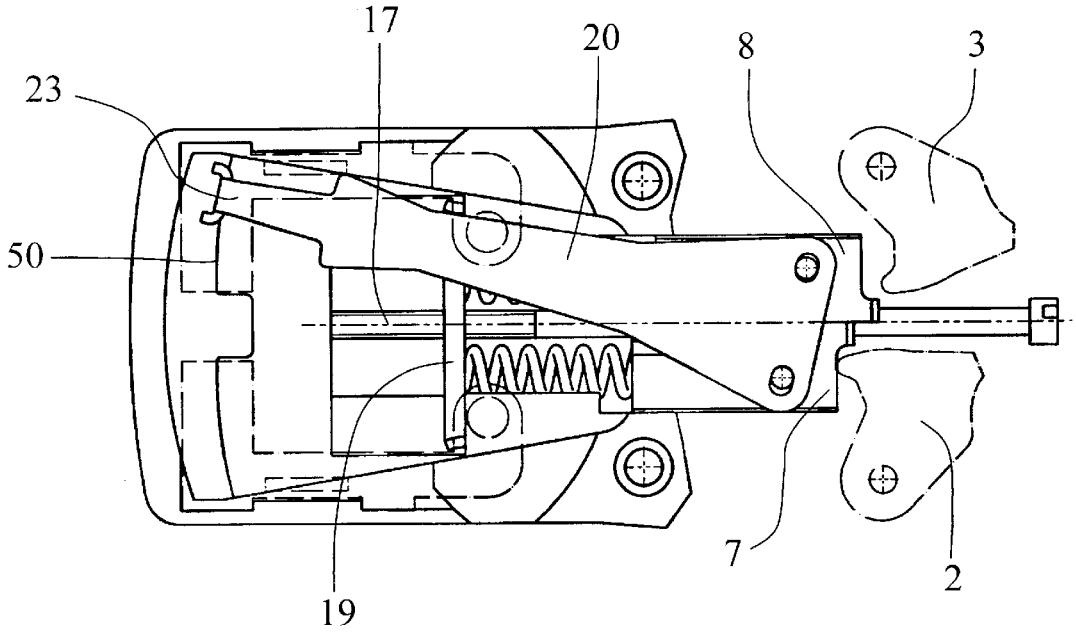

SAFETY BINDING FOR SKI BOOT

BACKGROUND OF THE INVENTION

The invention relates to a safety binding for ski boot, in particular, the invention relates to the means for controlling release of the ski bindings such as described in document CH 686 707 the contents of which are incorporated herein by reference thereto, in order, more simply, to produce an asymmetrical or symmetrical binding with automatic positioning by the boots using a sole clamp and a piston.

The sole clamp is preferably divided into two independent sole clamps, each mounted so as to pivot about an individual axis.

A binding of this type, which includes a single sole clamp and a single piston, is known from patent CH 686 707. This binding has the advantage of controlling, by means of a spring placed under the bearing surface of the boot on the binding, not only the pivoting of the sole clamp about a vertical axis in the event of a fall, but also the rocking of the sole clamp in a vertical plane. The arrangement of the spring under the bearing surface of the boot makes it possible to have a favorable relationship between the load moments exerted on the boot in the horizontal plane and in the vertical plane. A binding of the same type, but one which includes two sole clamps is known. The sole clamps constitute two levers of the first class, having divergent arms for laterally holding the boot, and two convergent arms substantially perpendicular to the longitudinal axis and each equipped with a descending arm bearing at two points which are close to one another on the end of a piston mounted axially in the body of the binding extending under the boot and pushed by a spring. The presence of two sole clamps with two close bearing points makes it possible to reduce the lateral forces on the piston and, consequently, to reduce the friction forces opposing the sliding of the piston. The friction of the sole clamps on the flange of the boot is also less than in a binding with a single sole clamp. According to an embodiment shown in that document, the sole clamps bear on two parallel pistons, but it is revealed that it is preferable to have a single piston common to the two sole clamps. The inventor has thus not seen the advantage he could draw from having two pistons.

Patents FR 1 503 847, 1 503 848, and 1 503 849, the contents of which are incorporated by reference, furthermore disclose bindings with resistance to asymmetric release in order to take account of the fact that the skier's knee, subject to twisting forces at the time of a fall, is more vulnerable to an inward rotation of the foot than to an outward rotation of the foot. As these bindings require pairing between boots and skis, i.e. a left ski for the left foot, and a right ski for the right foot, and as swapping the skis round has an effect which is the reverse of the desired effect, which may have serious consequences, a binding has been sought which adapts automatically to the boot when the boot is fitted into the binding. The skier can thus fit his boot into either ski as he is accustomed to doing, with the advantage of having bindings with lower resistance to release in the event of stresses from inward rotation of the foot than in the event of outward rotation. Such bindings are described in documents U.S. Pat. No. 5,639,108, the content of which is incorporated by reference, U.S. Pat. No. 5,722,679, the content of which is incorporated by reference, WO 96/32168, the content of which is incorporated by reference, and EP 0 739 646, the content of which is incorporated by reference. These bindings have in common a conventional design for the toe piece, i.e. a spring arranged in front of the sole clamp, at the location of the boot flange. The sole clamp is either in a single piece, with the spring pivoting with the sole clamp (U.S. Pat. No. 5,639,108), or in two components, in the form of a lever bearing on a rod (U.S. Pat. No. 5,722,679, WO 96/32168, EP 0 739 646). The binding is made asymmetrical by means of a complex mechanism controlled magnetically or electromagnetically by the boot equipped, for this purpose, with bosses or with a permanent magnet.

SUMMARY OF THE INVENTION

A safety binding for ski boot, of which the sole has a flange comprising a binding body of which a horizontal part, intended for vertical support of the boot and extending under the boot, contains a pair of movable pistons stressed by elastic means, and another part carries a sole clamp for holding the boot via its flange, this sole clamp being mounted so as to pivot about an at least approximately vertical axis in order to release the boot, and pivoting by an angle limited in a vertical plane about a real or virtual axis located at the location of holding of the boot by the sole clamp, this sole clamp being equipped with two descending arms rigidly connected to the sole clamp, the ends of which bear respectively on each of the pistons.

The sole clamp is preferably divided into two independent sole clamps, each mounted so as to pivot about an individual axis.

The object of the present invention is to take advantage of the presence and of the arrangement of the two pistons of the means for controlling release of the bindings described in document CH 686 707 in order, more simply, to produce an asymmetrical or symmetrical binding with automatic positioning by the boots.

The binding according to the invention is defined in that the elastic means consist of two parallel springs on which each of the pistons bears, respectively, wherein the pistons are connected together by a linking means, and wherein the binding comprises means for controlling this linking means which are capable of occupying a first position, in which the pistons are secured by the linking means, and a second position in which one of the pistons is able to move on its own, at least over a certain travel common to the two pistons and over at least a portion of the total travel of the two pistons.

Like the pistons and the springs, the control means may be arranged entirely under the boot bearing plate. The necessary mechanism is relatively simple and compact.

The sole clamp is preferably divided into two independent sole clamps, each mounted so as to pivot about an at least approximately vertical individual axis and consisting of two levers of the first class having two divergent lever arms for laterally holding the boot, and two convergent arms at least approximately perpendicular to the longitudinal axis of the binding and bearing, respectively, on the end of each of the pistons via a descending arm at two points which are close to one another.

According to one embodiment of the invention, the linking means consists of a small bar articulated to each of the pistons.

Clearance is provided at at least one of the articulations or in the guiding of the pistons in order to allow the small bar to pivot.

The binding may thus be used either as an asymmetrical binding or as a conventional symmetrical binding.

According to one embodiment, the means for positioning the small bar comprise means for controlling the small bar comprising means for holding the small bar in its median position, these holding means being able to occupy two positions, i.e. a position in which the small bar is held or a position in which the small bar is released.

According to one embodiment, the means for holding the small bar comprise a pair of independent holding components holding the small bar on each side via its sides.

According to embodiments, the means for controlling the small bar comprise components made from ferromagnetic material or permanent magnets so as to be able to be actuated by a boot equipped with a permanent magnet.

The holding components consist of rockers or of studs that are movable in translation perpendicularly to the plane of the binding. These rockers and these studs could themselves be made from ferromagnetic material so as to be able to be attracted by a magnet equipping the boot.

According to a further embodiment, the components for holding the small bar consist of rockers which can be rocked mechanically by studs or the like fixed on one side of the boots.

The binding also preferably comprises a second, fixed means for laterally holding the small bar, arranged such that the small bar is released only after a certain simultaneous travel of the two pistons. This second means advantageously consists of a notch in which the curved end of the small bar is engaged.

BRIEF DESCRIPTION OF THE DRAWINGS

The appended drawing shows, by way of example, embodiments of the invention.

FIG. 4 is a top plan view of the mechanism according to FIG. 2 in the asymmetrical position, during release, also showing the means for adjusting hardness, in this case in the position of minimum hardness.

FIG. 5 is a view similar to that of FIG. 4, but with the hardness adjustment in the position of maximum hardness.

DESCRIPTION OF THE PREFERRED EMBODIMENTS

Figure 1:
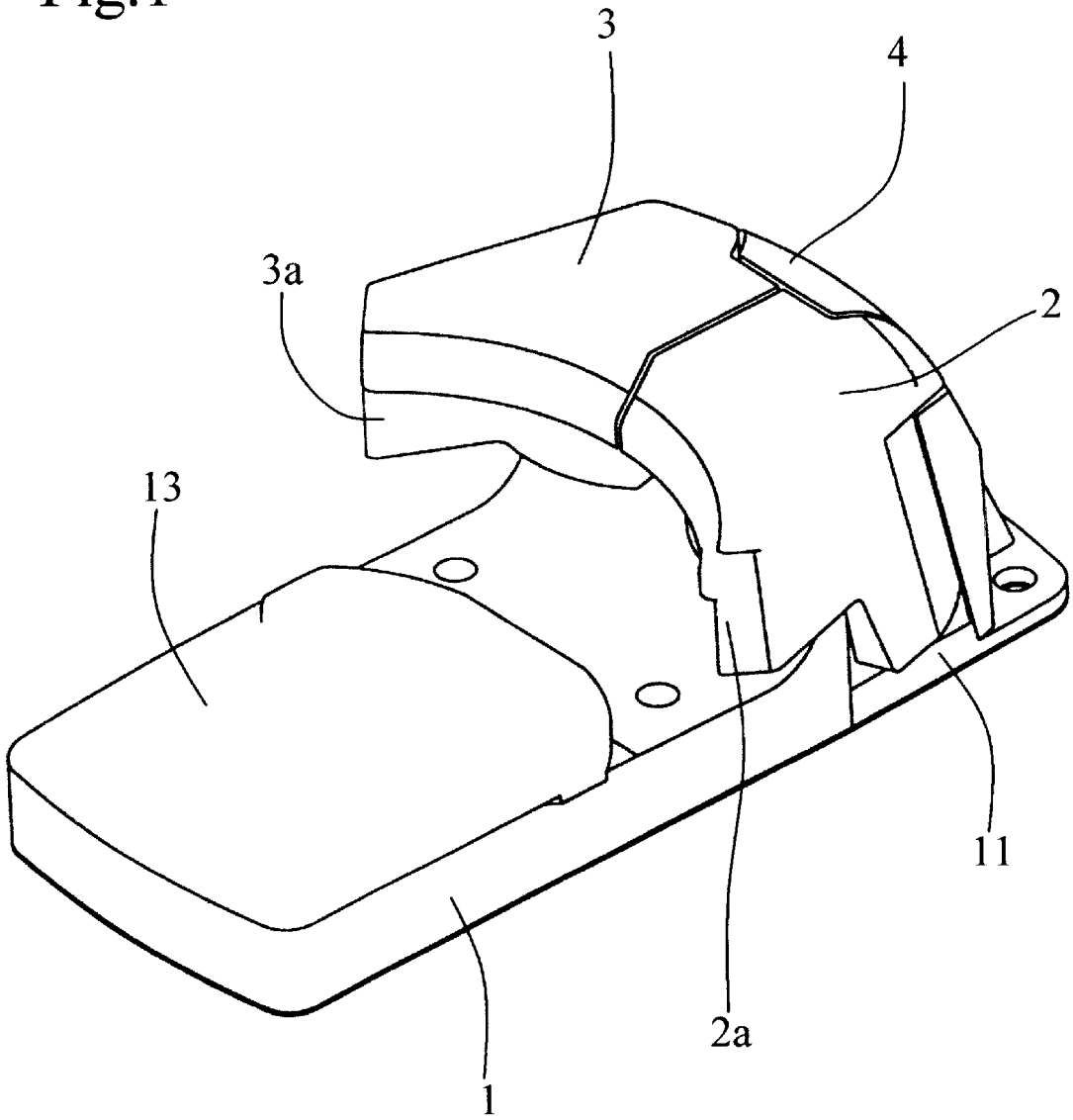
FIG. 1 is a perspective view of a binding, more precisely of a toe component as shown in the first two embodiments which will be described.
Figure 8:
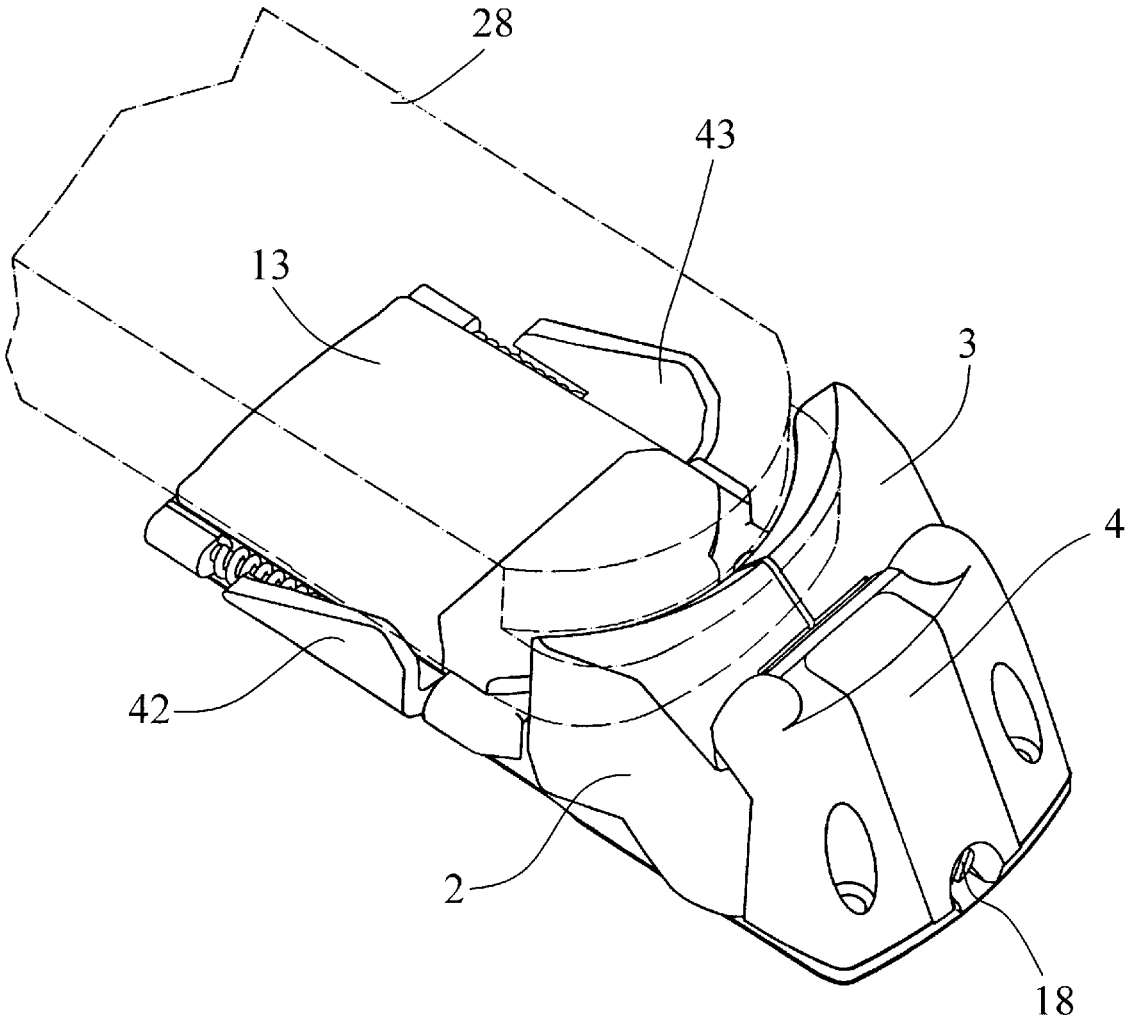
FIG. 8 is a perspective view of a toe piece according to a third embodiment.
Figure 9:
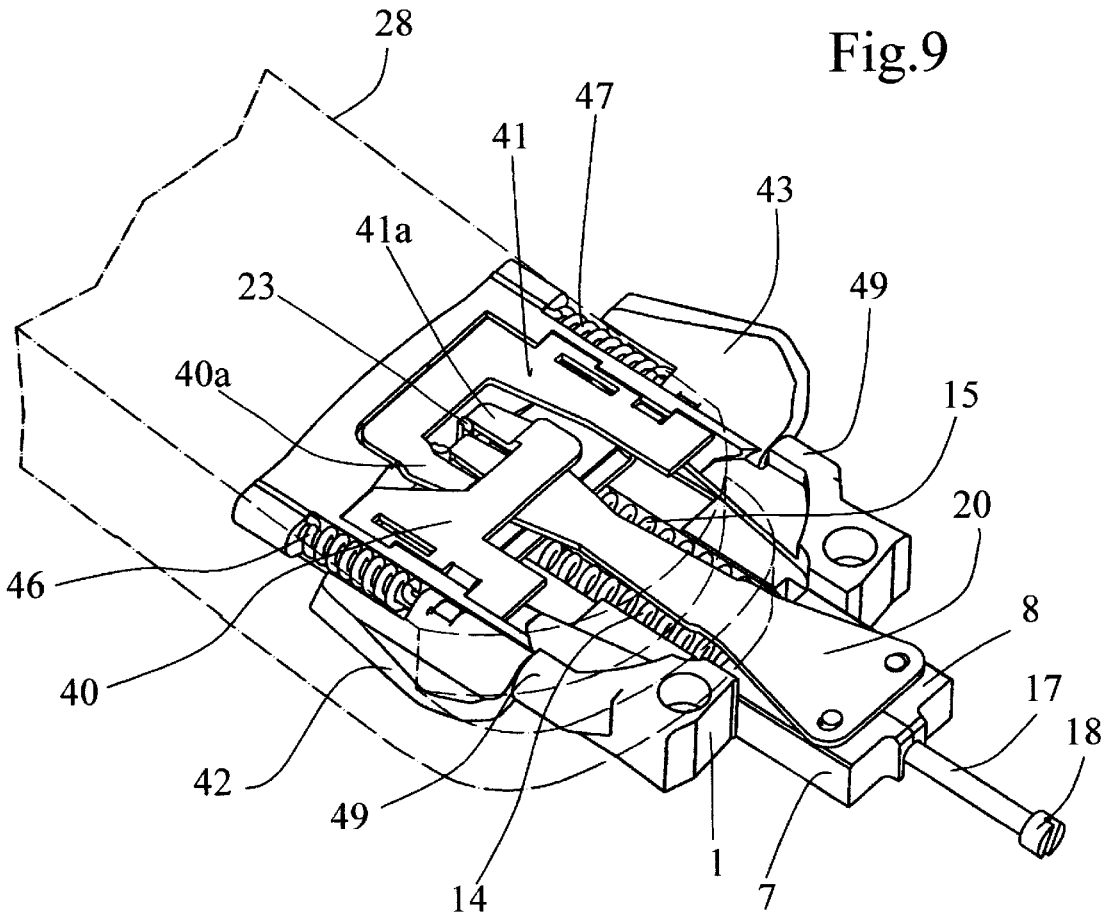
FIG. 9 shows the mechanism of this third embodiment in the symmetrical position and during release.
Figure 10:
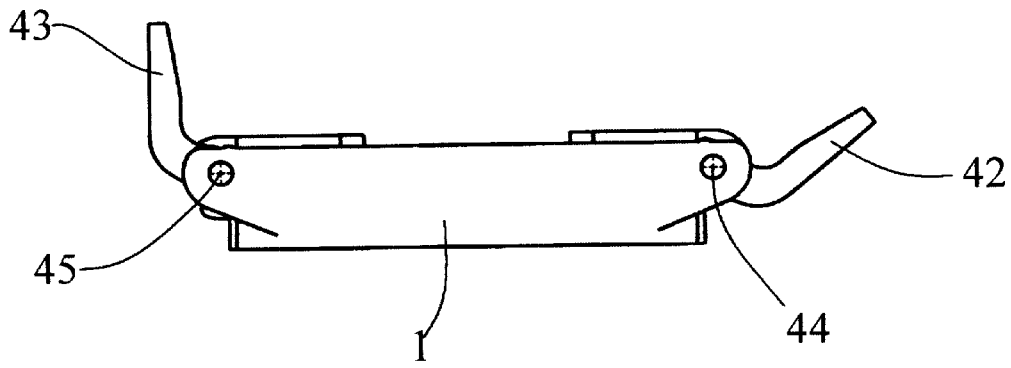
FIG. 10 is a view in elevation of the rear, in the direction of the arrow shown in FIG. 11.
Figure 11:
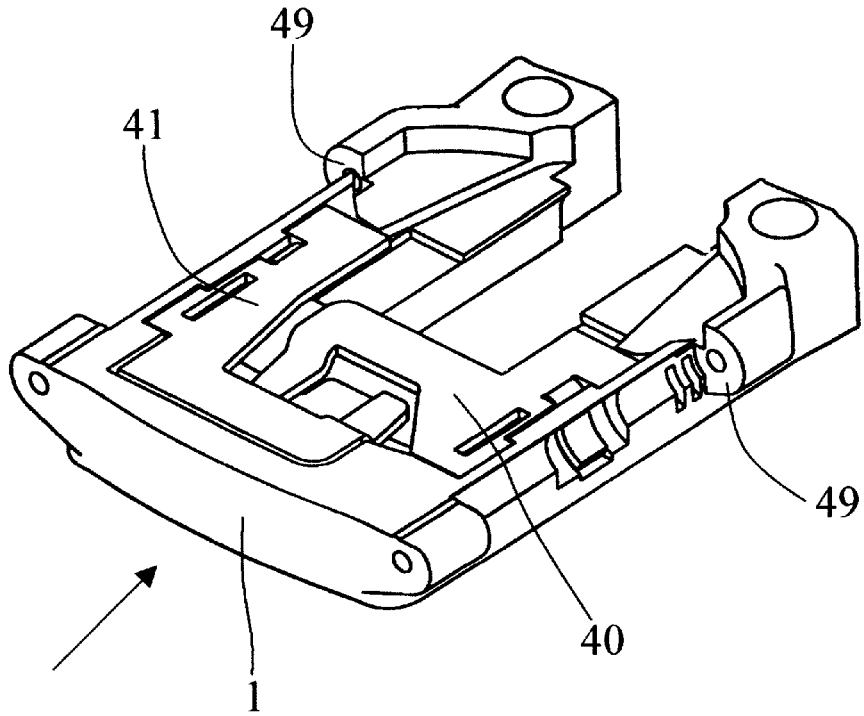
FIG. 11 shows a part of the mechanism, without the pistons and springs and without the means for controlling the rockers.
Figure 12:
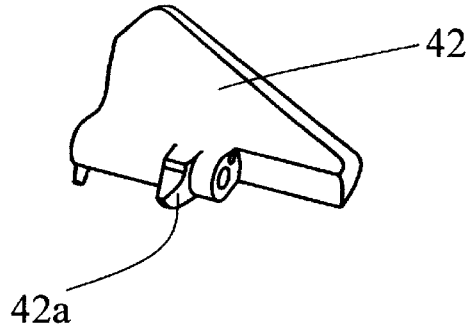
FIG. 12 shows one of the control levers of the rockers.
Figure 13:
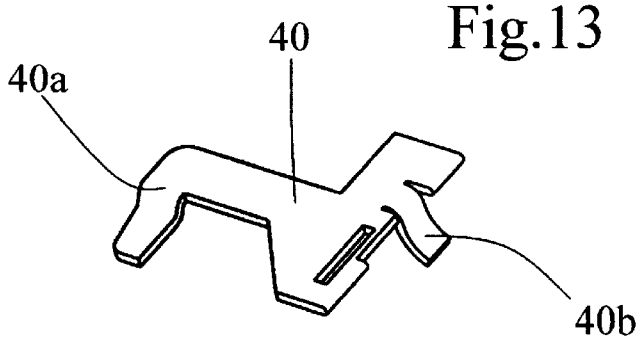
FIG. 13 shows one of the rockers.
Figure 14:
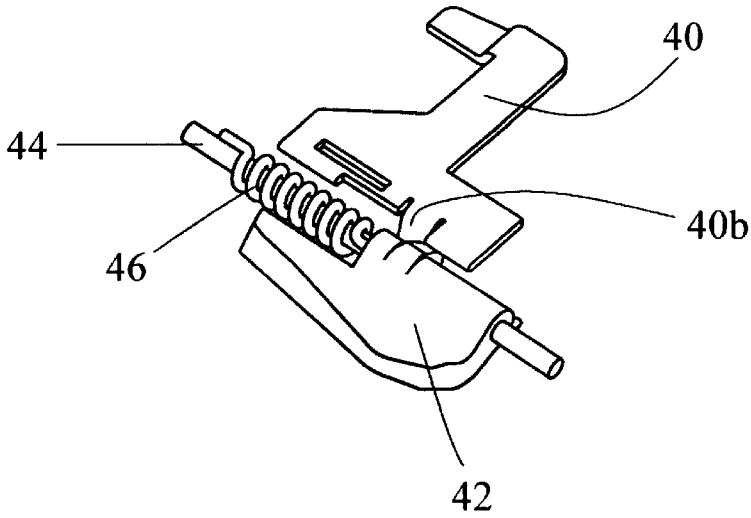
FIG. 14 is a detail of FIG. 9, showing one of the rockers and its control lever.

The binding shown in FIG. 1 comprises a binding body 1 for fixing to a ski, on which body there is a pair of sole clamps 2 and 3 for holding a boot via its standard front flange, as shown in FIG. 8, in which the boot is shown in broken lines. The sole clamps 2 and 3 are each mounted so as to pivot about an approximately vertical individual axis, and they are also able to rock through a limited angle about a horizontal transverse axis. The sole clamps 2 and 3 are mounted as shown in FIG. 26 of document WO 00/29078, which must be regarded as forming an integral part of the present description. Reference should thus be made to that document regarding any detail concerning the form and mounting of the sole clamps 2 and 3. Regarding the form of the sole clamps, this is shown in detail in FIG. 4 of the cited document. It will simply be mentioned that the sole clamps 2 and 3 constitute two levers of the first class, having two divergent arms 2*a* and 3*a* for holding the boot laterally, and two convergent arms substantially perpendicular to the longitudinal axis and each equipped with a descending arm 5, 6 (FIG. 4) bearing at two points close to one another and, respectively, on two parallel pistons 7 and 8 moving horizontally parallel to the longitudinal axis of the binding. FIG. 4 also diagrammatically shows the approximately vertical pivoting axes 9 and 10 of each of the sole clamps 2 and 3. As may be seen in FIG. 1, the mounting plate 4 is equipped with a base 11 distinct from the binding body 1.

Figure 3:
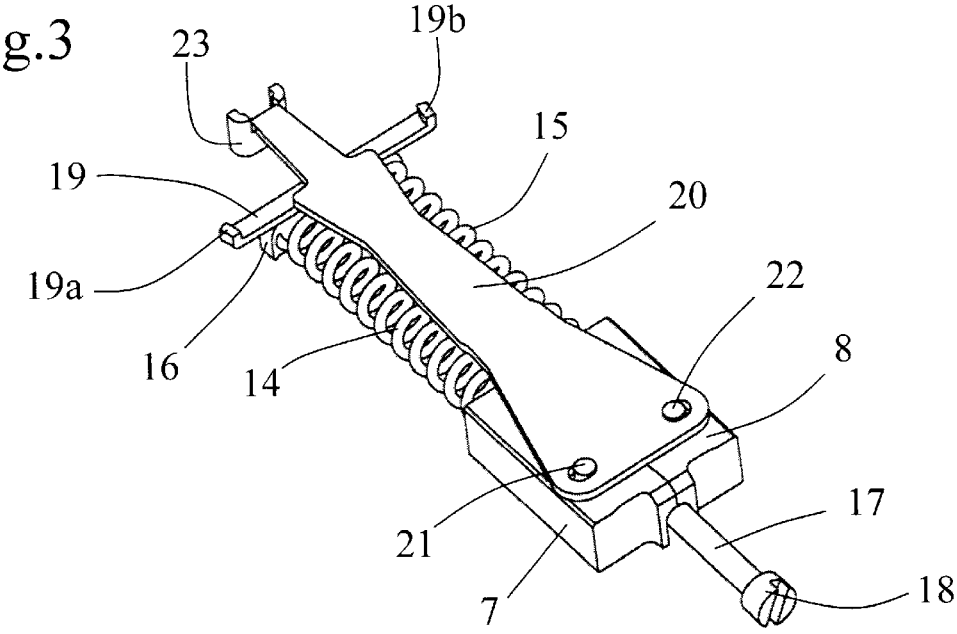
FIG. 3 shows the central part of the mechanism according to FIG. 2.

Behind the sole clamps 2 and 3, i.e. in a region located under the boot, the device for controlling release of the binding is mounted in the binding body 1, as in the bindings described in document WO 00/29078. This mechanism is mounted in a housing 12 of the body 1, and it is covered by a cover plate 13 on which the boot rests. The pistons 7 and 8 are of rectangular parallelepipedal general shape. They are guided partially in the base 11 and partially in the binding body 1. The piston 7 bears on a first spring 14 and the piston 8 on a second spring 15 identical to the spring 14 mounted parallel with the latter. These springs 14 and 15 bear, via their upper end, on a transverse small plate 16 (FIG. 3), simultaneously forming a nut which is stationary in rotation engaged on a screw 17 extending axially through the binding and equipped with a head 18 bearing on the mounting plate 4 at the front of the binding, as may be seen in FIG. 8. As will immediately have been understood, the screw 17 serves for adjusting the precompression of the springs 14 and 15, i.e. the hardness of the binding at the time of release. A stirrup 19, the role of which will be described below, is fixed on the bearing small plate 16.

The pistons 7 and 8 are connected together by a small bar 20 articulated on the pistons 7 and 8 about two studs 21 and 22. These articulations have transverse clearance so as to allow a rectilinear displacement of the pistons, whereas the pivoting of the small bar 20 tends to impart to these studs a trajectory in the form of an arc of a circle. The small bar 20 extends toward the rear of the binding, along the axis of symmetry of the binding, in the neutral or symmetrical position of the binding. The small bar has an end 23, which is curved toward the bottom, engaged in a notch 38 of the body 1, opening toward the rear. A rocker 24 and 25, respectively, is mounted on each side of the housing 12 of the binding body. These rockers have a control arm 24*a,* 25*a* and a holding arm 24*b,* 25*b*. All these arms are directed toward the axis of symmetry of the binding. The control arms 24*a* and 25*a* carry a magnetized pad 26, 27, for example made from ferrite. If the rockers 24 and 25 are made from non-ferromagnetic material, the pads 26 and 27 could be simply made from a ferromagnetic material. The curved end 23 of the small bar has two wings for abutting against one of the arms 24*b* or 25*b*.

Figure 2:
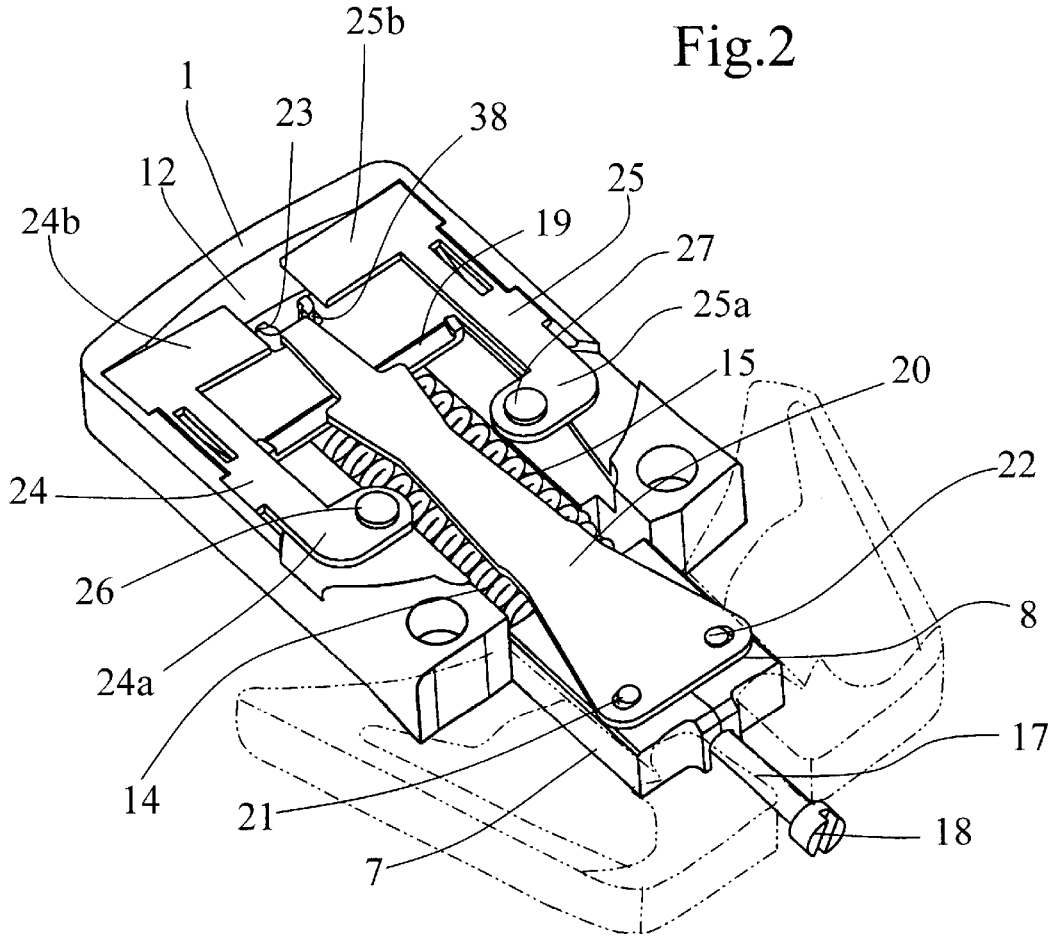
FIG. 2 is a perspective view of the mechanism for controlling release of the binding according to a first embodiment, in a neutral or symmetrical position.

In the position shown in FIG. 2, the small bar 20 is held in the median position by the notch 38 in which the end 23 of the small bar is engaged, and the pistons 7 and 8 are aligned transversely. In the absence of stress on the control arms 24*a* and 25*a,* the arms of the rockers occupy a low position through the effect of their own weight and, if necessary, through the effect of an auxiliary spring. The binding is symmetrical, i.e. it will have the same resistance to release whichever one of the sole clamps is entrained by the boot. This will become clearly apparent during the description of the operation of the binding.

Figure 7:
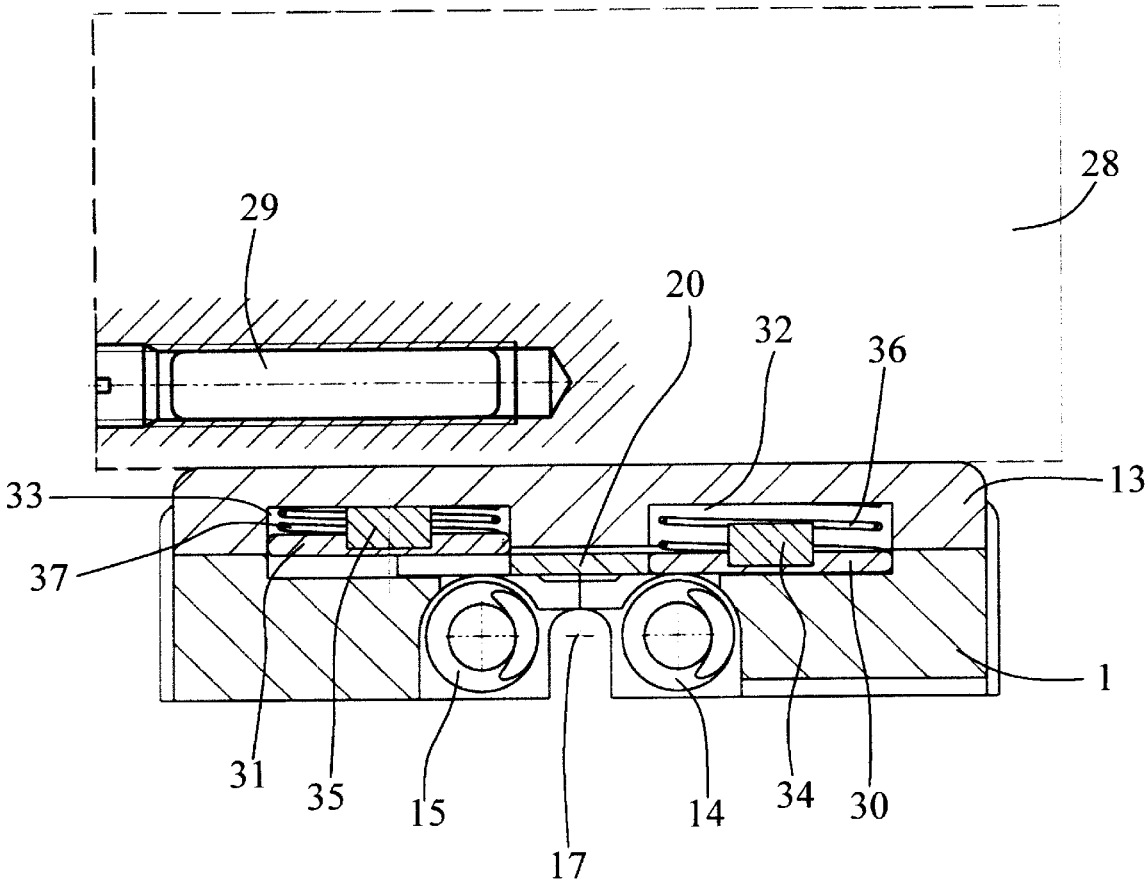
FIG. 7 is a vertical transverse sectional view of FIG. 6, showing the control of the mechanism by a boot equipped with a magnet.

Suppose, now, that the skier is wearing a boot such as the boot shown diagrammatically by the rectangle 28 in FIG. 7. The sole of this boot contains a permanent magnet 29 arranged asymmetrically so that when the boot is fitted into the binding it is placed opposite one of the pads 26 or 27.

If, for example, the permanent magnet 29 is placed above the pad 27, this pad is attracted toward the sole of the boot and the rocker 25 is raised. Its arm 25*b* is no longer able to hold the small bar 20 laterally.

If the boot in entrained outward, as shown in FIG. 4, the sole clamp 2 is entrained by the boot and its arm 5 pushes the piston 7 rearward. The small bar 20, held in the notch 38 via its end 23, is not released immediately, so that the two pistons 7 and 8 are initially entrained. After a certain travel, the curved end 23 escapes the notch 38 and the small bar 20 can then pivot. This measure prevents accidental pivoting of the sole clamp located on the inner side of the boot during normal stress. A movement of the sole clamp in this case would, however, be prejudicial to proper guiding of the skis and could even give rise to a fall. This measure therefore makes it possible, using very simple means, to obtain favorable non-linear behavior.

When the force on the pistons 7 and 8 is sufficient to release the small bar 20 from the notch 38, the small bar 20, which is not held by the rocker 25, is able to pivot, as shown in FIG. 4, such that the piston 7 can be displaced on its own without entraining the piston 8. Only the spring 14 continues to be compressed, so that the resistance to release is substantially reduced relative that offered in the symmetrical position shown in FIG. 2. After a certain travel of the piston 7, the small bar 20 abuts against the end 19*b* of the stirrup 19. If the piston 7 continues its displacement, it then entrains the piston 8 such that the resistance to release increases. The same effect is produced if the small bar abuts against the lateral wall of the housing 12 The piston 7 is therefore displaced on its own only over a portion of its travel. When the stress on the sole clamp 2 ceases, the spring/piston/small bar system tends to return to its initial position of equilibrium, and the end 23 of the small bar 20 re-engages in the notch 38. The curved end 23 of the small bar 20 bears on the cylindrical face 50, which is smooth so as to facilitate the sliding of the end 23 through the effect of the tangential component of the force acting on the small bar 20. The face 50 has a curvature which promotes recentering of the small bar 20.

If it is the sole clamp 3 that is stressed, it pushes back the piston 8. In such a case, the small bar 20 cannot pivot as it is held by the rocker 24, and the piston 7 is entrained with the piston 8.

FIG. 5 shows a release which is similar to the release shown in FIG. 4, but with maximum hardness adjustment of the binding, the springs 14 and 15 being strongly precompressed by means of the screw 17. In such a case, it will be seen that the small bar 20 abuts against the lateral wall of the housing 12.

The shape of the curvature of the face 50 influences the release curve. If, for example, the center of curvature of the part 50*a* of the face 50, on which the small bar 20 bears in FIG. 4, is located at A, the spring 15 is neither compressed nor relaxed when the small bar 20 is displaced along the part 50*a* of the face 50. If the center of curvature is at B, the spring 15 relaxes, and if the center of curvature is at C the spring 15 is compressed and the recentering force is increased. The center of curvature of the part 50*b* of the face 50 is, naturally, symmetrical to that of the part 50*a*. The position of the centers of curvature of the faces 50*a* and 50*b* will thus be chosen as a function of the desired release curve shape.

To allow pivoting of the small bar 20, clearance at only one of its articulations on the pistons would be sufficient. Instead of having clearance at the articulations, lateral clearance could be arranged in the guiding of the pistons 7 and 8.

Figure 6:
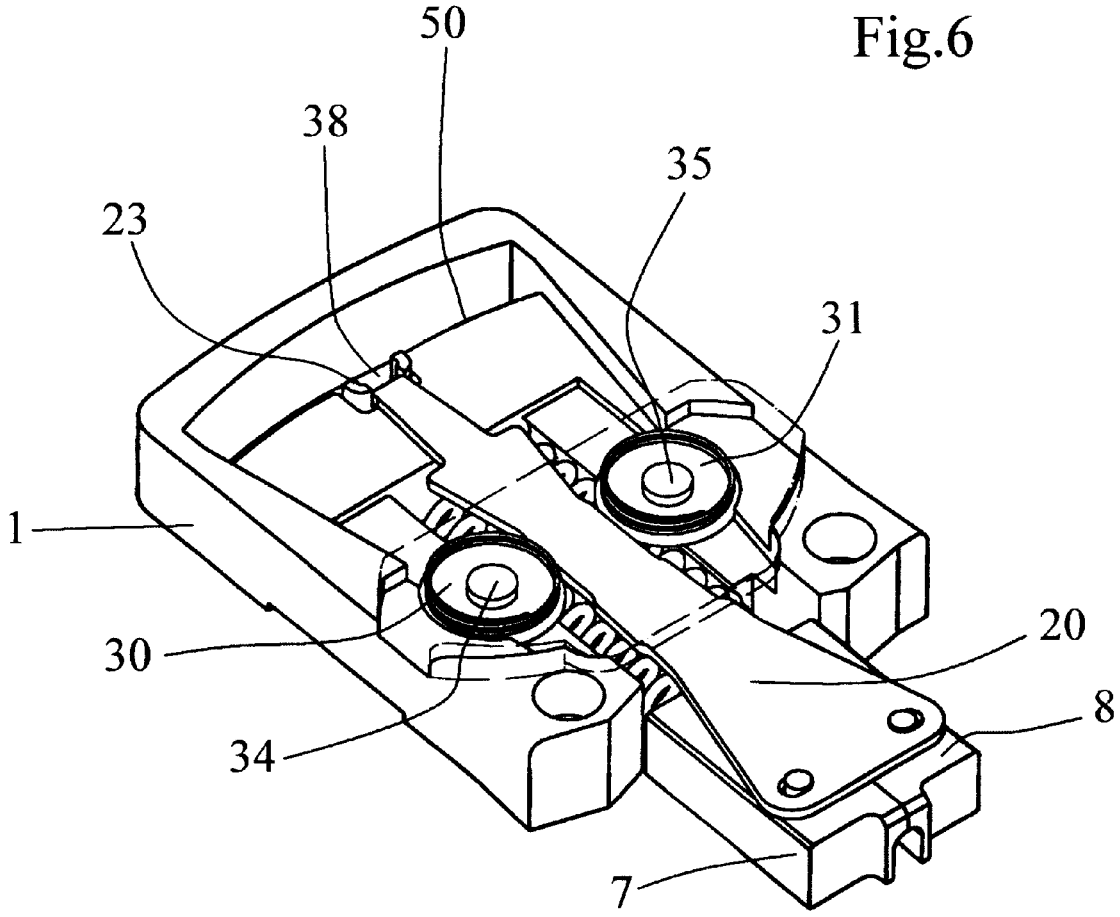
FIG. 6 is a perspective view of a mechanism according to a second embodiment.

The embodiment shown in FIGS. 6 and 7 differs from the first embodiment only in terms of the means for laterally holding the small bar 20. These holding means consist of two, relatively thin studs 30 and 31, which are here in the form of a disk mounted so as to be movable vertically, i.e. perpendicularly to the plane of the binding, in housings 32, 33 made partly in the binding body 1 and partly in the cover plate 13. A permanent magnet 34, 35 or a corresponding component made from ferromagnetic material is fixed in the center of these studs. The studs 30 and 31 are held in a low position by a spring 36, 37, respectively. In this low position, the studs 30 and 31 are located on each side of the small bar 20, at the same level as the latter, so that they Laterally hold the bar 20 on each side. The small bar 20 is also held laterally by the engagement of its curved end 23 in the notch 38, as in the preceding embodiment.

If the magnet 29 of the boot 28 is placed above one of the magnets, for example above the magnet 35, said magnet is attracted toward the sole so that the stud 31 releases the small bar 20. This second embodiment also differs slightly from the first embodiment in that pivoting of the small bar 20 is not limited by a stirrup.

A third embodiment, with purely mechanical control, is shown in FIGS. 8 to 18. In this embodiment, there are two rockers 40 and 41 articulated like the rockers 24 and 25 on the sides of the binding body, and their function is the same. The rockers 40 and 41 have a curved arm 40*a,* 41*a,* respectively, and these arms laterally hold the small bar 20 via its curved end 23. It will be noted that the small bar 20 is exactly the same in the three embodiments. The rocker holding arms are, in this case, elongate and intersect in order to increase the vertical displacement of the ends of these arms.

The rockers 40 and 41 are actuated by cams 42 and 43 mounted on each side of the body of the binding. These cams are mounted on pins 44 and 45 which are parallel to the longitudinal axis of the binding, and on them the cams can be displaced in translation and in rotation. The cams 42 and 43 are stressed by a spring 46, 47 working both in compression and in torsion. These springs thus tend to push the cams 42 and 43 forward, in abutment against the stops 49 formed on the binding body, and to hold the cams in a vertical position.

Figure 15:
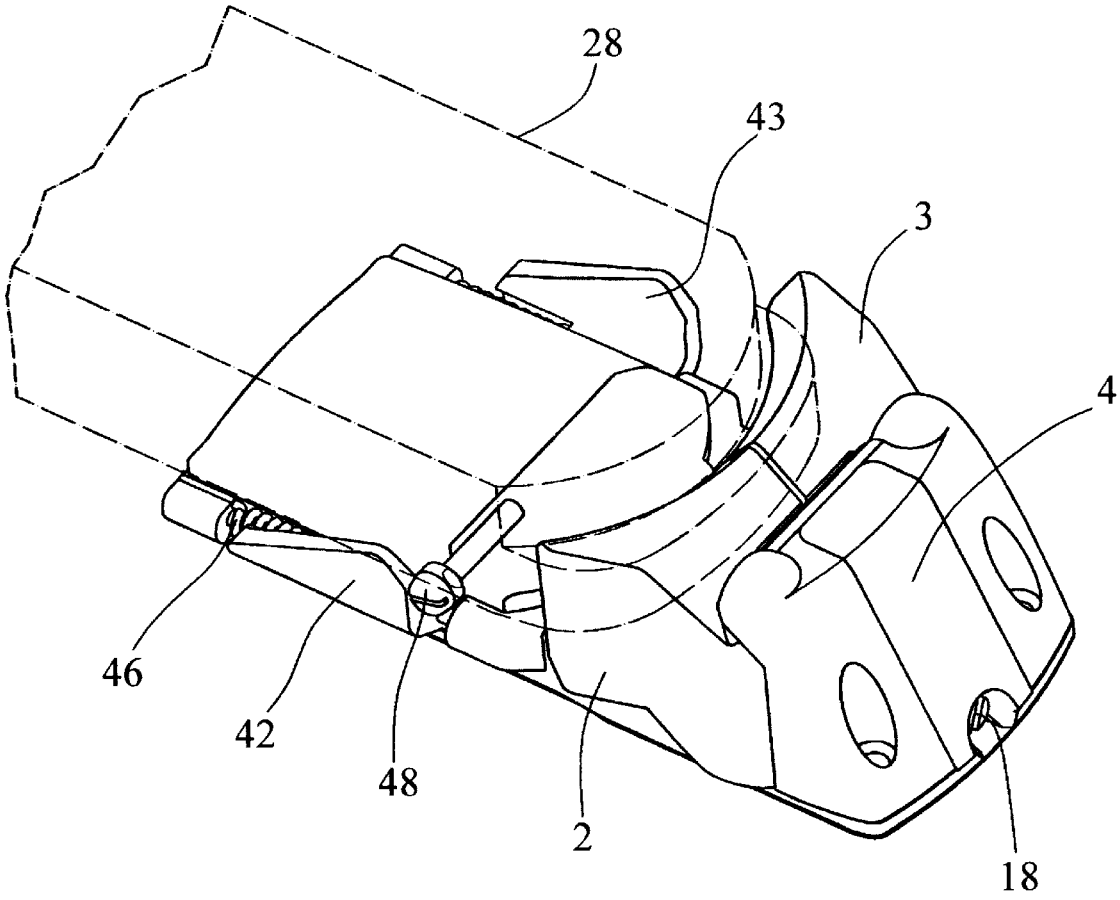
FIG. 15 shows the automatic positioning of the binding by a boot in the third embodiment.
Figure 16:
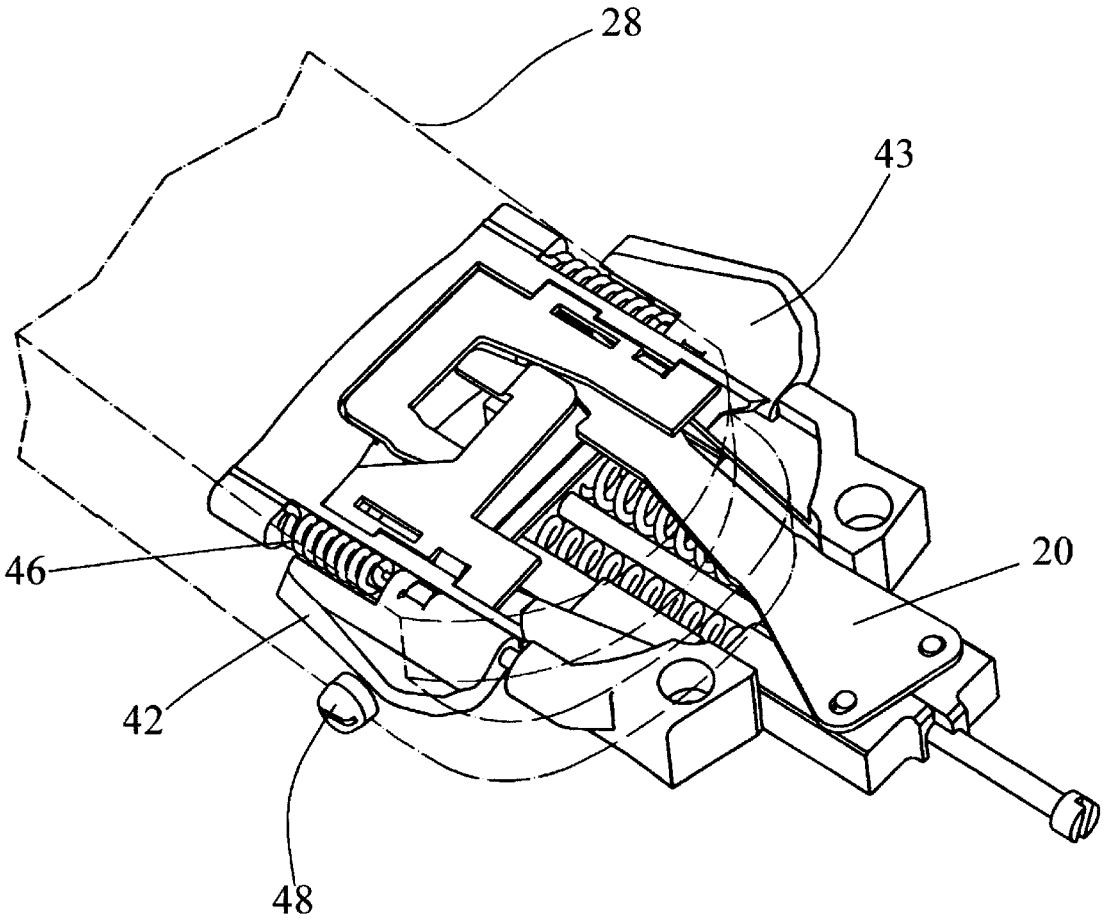
FIG. 16 shows the binding and the boot according to FIG. 15 during release.
Figure 17:
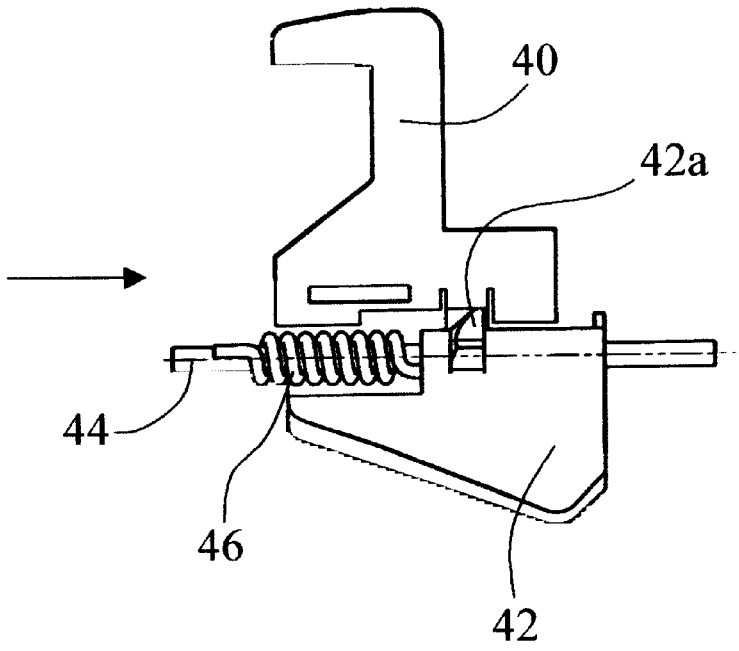
FIG. 17 is a plan view of the raised rocker and of its control lever in the same position as FIG. 16.
Figure 18:
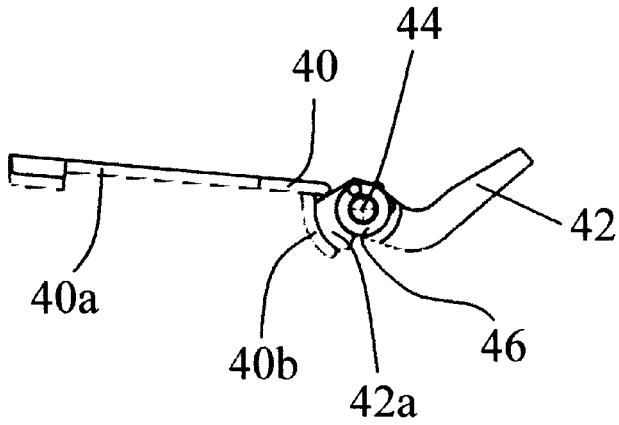
FIG. 18 is a view in elevation of the components of FIG. 17, seen in the direction of the arrow shown in FIG. 17.

The rocker 40 and its control cam 42 are shown in detail in FIGS. 12, 13, 14, 17, and 18. The rocker 40 has, on the side opposite the arm 40*a*, relative to its axis of pivoting, a tab 40*b* which is slightly curved in the form of an arc of a circle. The cam 42 has a projection 42*a* which also acts as a cam and pushes the tab 40*b* of the rocker 40 during rearward translational displacement of the cam 42, which has the effect of rocking the rocker 40, i.e. of raising its arm 40*a* as shown in FIGS. 17 and 18. For actuation of the cam 42 or of the cam 43, the boot 28 is equipped, in this case, with a nipple, stud, finger or the like 48 projecting slightly on the side of the sole, as shown in FIG. 15.

When the boot is fitted into the binding, this stud 48 pushes the cam 42 rearward, which actuates the rocker 40, releasing the small bar 20 on one side, as in the first embodiment.

During release of the binding in torsion, the cam 42 opposes only the very low torsional resistance of its spring 46, so that it rocks outward in order to allow the boot to pass.

Multiple variations and modifications are possible in the embodiments of the invention described here. Although certain illustrative embodiments of the invention have been shown and described here, a wide range of modifications, changes, and substitutions is contemplated in the foregoing disclosure. In some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed:

1. A safety binding for a ski boot of which the sole has a flange, the binding comprising a binding body of which a horizontal part, intended for vertical support of the boot and extending under the boot, contains a pair of movable pistons biased by elastic means, and another part carries a sole clamp for holding the boot via its flange, this sole clamp being mounted so as to pivot about at least one at least approximately vertical axis in order to release the boot, and pivoting by an angle limited in a vertical plane about a real or virtual axis located at the location of holding of the boot by the sole clamp, this sole clamp being equipped with two descending arms rigidly connected to the sole clamp, the ends of which bear respectively on each of the pistons, wherein the elastic means comprises two parallel springs on which each of the pistons bear, respectively, wherein the pistons are interconnected by a linking means, and wherein the binding comprises means for controlling this linking means which arc capable of occupying a first position, in which the pistons are secured by the linking means, and a second position in which one of the pistons is able to move on its own, at least over a certain travel common to the two pistons and over at least a portion of the total travel of the two pistons.

2. The binding as claimed in claim 1, wherein the linking means comprises a small bar articulated to each of the pistons.

3. The binding as claimed in claim 2, wherein the means for controlling the small bar comprise means for holding the small bar in its median position, these holding means being able to occupy two positions, i.e. a position in which the small bar is held or a position in which the small bar is released.

4. The binding as claimed in claim 3, wherein the means for holding the small bar comprise a pair of independent holding components holding the small bar on each side via its sides.

5. The binding as claimed in claim 3, wherein the means for controlling the small bar comprise components made from ferromagnetic material or permanent magnets so as to be able to be actuated by a boot equipped with a corresponding permanent magnet or ferromagnetic material.

6. The binding as claimed in claim 4, wherein the means for controlling the small bar comprise components made from ferromagnetic material or permanent magnets so as to be able to be actuated by a boot equipped with a corresponding permanent magnet or ferromagnetic material.

7. The binding as claimed in claim 6, wherein the holding components comprise rockers.

8. The binding as claimed in claim 7, wherein the rockers have a first arm for holding the small bar, and a second arm directed in the same direction as the first arm and carrying a permanent magnet or ferromagnetic material for being attracted by a corresponding magnet or ferromagnetic material on a boot for raising the rocker and releasing the small bar.

9. The binding as claimed in claim 4, wherein the holding components are movable perpendicularly to the plane of the binding against the action of springs, and wherein they carry a component made from ferromagnetic material or a permanent magnet, or they are themselves made from ferromagnetic material for actuation by a magnet equipping a boot.

10. The binding as claimed in claim 4, wherein the components for holding the small bar comprise rockers which can be rocked mechanically by studs or the like fixed on one side of the boots.

11. The binding as claimed in claim 10, comprising means for actuating the rockers which comprise components mounted on the sides of the binding and which can be displaced by said studs against the action of return springs.

12. The binding as claimed in claim 11, wherein said components for actuating the rockers are mounted so as to pivot about an axis parallel to the longitudinal axis of the binding, and wherein they are stressed by a spring working both in compression and in torsion so as to allow said components to rock toward the outside of the binding in order to allow the boot to pass during release of the binding and to right these components when the boot has left the ski or when the boot is in the correct position on the ski.

13. The binding as claimed in one of claims 2 to 12, comprising a second, fixed means for laterally holding the small bar, arranged such that the small bar is released only after a certain simultaneous travel of the two pistons.

14. The binding as claimed in claim 13, wherein the second means for laterally holding the small bar comprise a notch in which the curved end of die small bar is engaged.

15. The binding as claimed in claim 14, having, on each side of said notch, a cylindrical face on which the curved end of the small bar bears after having escaped from said notch.

16. The binding as claimed in claim 15, wherein the position of the centers of curvature of the two cylindrical faces is chosen as a function of the desired release curve shape.

17. The binding as claimed in one of claims 2 to 12 or 14 to 16, comprising means for limiting the pivoting of the small bar, such that at the end of a certain pivoting the two pistons are forcibly entrained simultaneously.

18. The binding as claimed in one of claims 1 to 12 or 14 to 17, wherein the sole clamp is divided into two independent sole clamps, each mounted so as to pivot about an at least approximately vertical individual axis and constituting two levers of the first class having two divergent lever arms for laterally holding the boot and two convergent arms at least approximately perpendicular to the longitudinal axis of the binding and bearing, respectively, on the end of each of the pistons via a descending arm at two points which are close to one another.

19. A combination safety binding and ski boot, the ski boot having a sole and a long axis, wherein the sole of the boot has a flange, and wherein the boot is equipped with a permanent magnet or ferromagnetic material disposed therein asymmetrically about the long axis thereof, and wherein the binding comprises a binding body of which a horizontal part, intended for vertical support of the boot and extending under the boot, contains a pair of movable pistons biased by elastic means, and another part carries a sole clamp for holding the boot via its flange, this sole clamp being mounted so as to pivot about at least one at least approximately vertical axis in order to release the boor, and pivoting by an angle limited in a vertical plane about a real or virtual axis located at die location of holding of the boot by the sole clamp, this sole clamp being equipped with two descending arms rigidly connected to the sole clamp, the ends of which bear respectively on each of the pistons, wherein the elastic means comprises two parallel springs on which each of the pistons bear, respectively, wherein the pistons are interconnected by a linking means, and wherein the binding comprises means for controlling this linking means which are capable of occupying a first position, in which the pistons are secured by the linking means, and a second position in which one of the pistons is able to move on its own, at least over a certain travel common to the two pistons and over at least a portion of the total travel of the two pistons, the control means comprising components made from a permanent magnet or ferromagnetic material asymmetrically disposed about the long axis with respect to a corresponding permanent magnet or ferromagnetic material in the boot.

20. The combination as claimed in claim 19 wherein the linking means comprises a small bar articulated to each of the pistons.

21. The combination as claimed in claim 20, wherein the means for controlling the small bar comprise means for holding the small bar in its median position, these holding means being able to occupy two positions, i.e. a position in which the small bar is held or a position in which the small bar is released.

22. The combination as claimed in claim 21, wherein the means for holding We small bar comprise a pair of independent holding components holding the small bar on each side via its sides.

23. The combination as claimed in claim 21, wherein the means for controlling the small bar comprise the components made from ferromagnetic material or permanent magnets so as to be able to be actuated by the corresponding permanent magnet or ferromagnetic material of the boot.

24. The combination as claimed in claim 22, wherein the means for controlling the small bar comprise the components made from ferromagnetic material or permanent magnets so as to be able to be actuated by the corresponding permanent magnet or ferromagnetic material of the boot.

25. The combination as claimed in claim 24, wherein the holding components comprise rockers.

26. The combination as claimed in claim 25, wherein the rockers have a first arm for holding the small bar, and a second arm directed in the same direction as the first arm and carrying a permanent magnet or ferromagnetic material for being attracted by the corresponding magnet or ferromagnetic material of the boot for raising the rocker and releasing the small bar.

* * * * *

UNITED STATES PATENT AND TRADEMARK OFFICE

CERTIFICATE OF CORRECTION

PATENT NO. : 6,644,682 B2
DATED : November 11, 2003
INVENTOR(S) : Horn

It is certified that error appears in the above-identified patent and that said Letters Patent is hereby corrected as shown below:

Title page,
Item [74], *Attorney, Agent or Firm*, replace "Bognion S.A." by -- Bugnion S.A. --

Signed and Sealed this

Thirteenth Day of January, 2004

JON W. DUDAS
*Acting Director of the United States Patent and Trademark Office*